United States Patent [19]

Hashmi et al.

[11] Patent Number: 4,549,421

[45] Date of Patent: Oct. 29, 1985

[54] METHOD AND APPARATUS FOR REDUCING THE SECTION OF ELONGATED COMPONENTS

[75] Inventors: Mohammed S. J. Hashmi; George R. Symmons, both of Sheffield, England

[73] Assignee: National Research Development Corporation, London, England

[21] Appl. No.: 602,430

[22] Filed: Apr. 20, 1984

[30] Foreign Application Priority Data

Apr. 26, 1983 [GB] United Kingdom ..... 8311301

[51] Int. Cl.[4] ..... B21C 9/00; B21C 23/32; B21C 3/00

[52] U.S. Cl. ..... 72/41; 72/253.1; 72/274; 72/467

[58] Field of Search ..... 72/41, 42, 43, 44, 45, 72/60, 253.1, 274, 467, 700

[56] References Cited

U.S. PATENT DOCUMENTS

| | | | |
|---|---|---|---|
| 3,345,842 | 10/1967 | Richards | 72/253.1 X |
| 3,406,443 | 10/1968 | De Ridder | 72/700 X |
| 3,763,680 | 10/1973 | Godfrey et al. | 72/467 X |
| 3,967,485 | 7/1976 | Oguchi et al. | 72/60 |
| 4,015,459 | 4/1977 | Winter et al. | 72/45 |
| 4,028,919 | 6/1977 | Austen | 72/253.1 |
| 4,270,373 | 6/1981 | Hirato et al. | 72/41 |
| 4,462,234 | 7/1984 | Fiorentino et al. | 72/41 |

FOREIGN PATENT DOCUMENTS

| | | | |
|---|---|---|---|
| 0042814 | 12/1981 | European Pat. Off. . | |
| 1002273 | 7/1957 | Fed. Rep. of Germany . | |
| 1144296 | 3/1969 | United Kingdom . | |
| 1451058 | 9/1976 | United Kingdom . | |
| 1542648 | 3/1979 | United Kingdom . | |
| 183170 | 6/1966 | U.S.S.R. | 72/253.1 |
| 712174 | 4/1974 | U.S.S.R. . | |

OTHER PUBLICATIONS

A Novel Technique of Wire Drawing, Hashmi et al., vol. 24, No. 1, 1982, pp. 1–4.

*Primary Examiner*—E. Michael Combs

*Attorney, Agent, or Firm*—Cushman, Darby & Cushman

[57] ABSTRACT

Apparatus and method for reducing wire and other elongated components in section by passing them through a reservoir containing a substance which will act as a lubricating and pressurizing medium and then, surrounded by the medium but without solid-to-solid contact, through a cavity formed in two parts which meet at a step where the radius diminishes sharply. The least section of the cavity exceeds the section of the unreduced component. The reservoir may be provided with a heater whereby the medium may be melted after being introduced to the reservoir in solid form. The component may be either drawn or thrust, and may undergo a change in shape as well as in the size of its section as it is reduced.

10 Claims, 5 Drawing Figures

METHOD AND APPARATUS FOR REDUCING THE SECTION OF ELONGATED COMPONENTS

This invention relates to a method and apparatus for reducing the section of elongated components. It relates particularly, although not exclusively, to wire drawing. Traditionally, wire is drawn by being pulled through a tapered reduction die, the orifice of which is smaller than the initial section of the wire. The material of the wire is deformed plastically by contact with the die as it passes through the orifice, the least dimension of which equals the final section of the wire.

Normally the conical part of such dies has a total die angle of between say 5 and 25 degrees, and it is common practice to reduce the cross-sectional area of wire by say 10–45% in a single pass through such a die. In industrial wire drawing practice, lubrication is used to reduce the drawing load and die wear and hence maximise the reduction in section that can be obtained, as well as to improve the machine life and the surface finish of the product.

It has been customary to effect the lubrication by pre-treating the wire and by simply applying a suitable lubricant to the working interface of the die and the wire. Despite such precautions, however, die wear has always been a significant problem in machines in which the die and the wire either make direct contact, or, at best, are separated only by a lubricating film. This problem has persisted even since the introduction, some 20 years ago, of so-called hydrodynamic lubrication systems which have greatly improved the consistency with which a film of lubricant forms around the surface of the wire and travels with it as it passes through the die.

In apparatus using such systems lubricant under some pressure is positively confined within the space adjacent the working interface of the workpiece and die, and in one early proposal this was achieved by causing the wire to approach the die through a tube of diameter slightly larger than the wire diameter, sealed onto the inlet side of the die. The clearance defined between this long tube, the wire and the die was filled with lubricant, and once drawing began the motion of the wire served both to inhibit escape of the oil from the open end of the tube and to cause pressure in the lubricant at the inlet position of the traditional die to enhance lubrication.

Another disadvantage, applying both to the traditional drawing processes and to the hydrodynamic lubrication systems, is that to begin the process the leading end of the wire must first be reduced in section by some other means, in order that it can be passed through the die orifice and then gripped by the jaws that are to exert the drawing action. This not only takes time and labour but also weakens the leading end, so increasing the likelihood of the wire breaking at start-up, that is to say as drawing begins. Also the hydrodynamic lubrication systems require wire speed to generate pressure, so creating further start-up problems.

In a paper on pages 1 to 4 of JMES, vol 24, 1982, published by the Institution of Mechanical Engineers, authors including the present inventors proposed a new and so-called die-less method of wire drawing using a conical cavity die and offering a clear prospect of reduced die wear because the least section of the die orifice is greater than the initial section of the wire itself, so that no direct contact between the wire and the die is even possible during drawing provided proper alignment of the wire is maintained. As in the hydrodynamic apparatus just described another vessel capable of containing liquid was sealed to the inlet side of the die and the wire was drawn through this vessel before reaching the die. Instead of the long open-ended tube of the hydrodynamic proposal, however, this vessel was a sealed and heated chamber connected to a source of low-density polyethylene granules. The action of the heater caused these to melt within the chamber, and when the wire was then drawn through the chamber and die cavity the hydrodynamic action of the wire upon the melt not only caused the melt to flow through the cavity outlet with the wire and emerge as a plastic coating upon the drawn wire. The reactions of the melt with the moving wire and with the conical walls of the cavity also raised the melt to a pressure which, in acting radially-inwards upon the wire, caused reductions of up to 21% in the section of the wire in a single pass through the die. Because the least dimension of the die orifice was greater than the starting section of the wire the method also eliminated the need for the leading end of the wire to be reduced in section before it could be passed through the orifice, problems of breakage at the start of the drawing due to this reduced section were thus eliminated, and die wear was negligible because no direct contact between die and workpiece took place.

The present invention results from appreciating, after further work on such die-less drawings processes, both that the conventional conical die shape is not so fundamental to such processes as had been assumed and also that another shape feature, which would be irrelevant to conventional drawing processes in which there is contact between the die and the workpiece, may offer particular advantages in die-less drawing. One aspect of our invention is a method of reducing an elongated component in section, in which that component in the presence of liquid is forced through the cavity of a die whose smallest orifice is of such size that the unreduced component will pass through it with clearance, and in which that component when in the course of reduction within the die passes a part of the cavity of stepped form where there is a substantially instant diminution of the radial dimension of the cavity.

The component may be pulled through the cavity as in conventional drawing, or at least part of the force to pass the component through the cavity may be applied as a thrust upon the component from upstream of the cavity. Where the component is pulled the result of the process may be a flexible product such as wire, and especially where part of the force is applied as thrust the result of the method may be a rigid structure such as rod, bar or tube.

Reduction of the section of the component may be accompanied by a change in the shape of that section, for instance from round to polygonal, and a temperature gradient may be maintained along the length of the stepped cavity.

The invention also includes apparatus for reducing a component in section and comprising a casing enclosing a cavity defining an axis of reduction. The cavity has an inlet located on that axis by which the component and liquid enter the cavity prior to reduction and a coaxial outlet through which the component passes with clearance after reduction, there are means to force the component through the cavity from inlet to outlet and in the process to be reduced in section by reaction with the liquid but without contact with the cavity, and the cavity is in two axially-succeeding parts separated by a step-form reduction in the radial dimension.

The shape of the outlet may be geometrically similar to that of the second part of the chamber, and while both parts of the chamber may often be circular in shape so that the finished component is of circular section also, the two parts of the chamber and in particular the second part may also be of other shapes—e.g. of polygonal section—so as to result in products of similar section.

The invention is further defined by the claims which are set out later in this specification, and will now be described, by way of example, with reference to the accompanying drawings in which:

Figure 1:
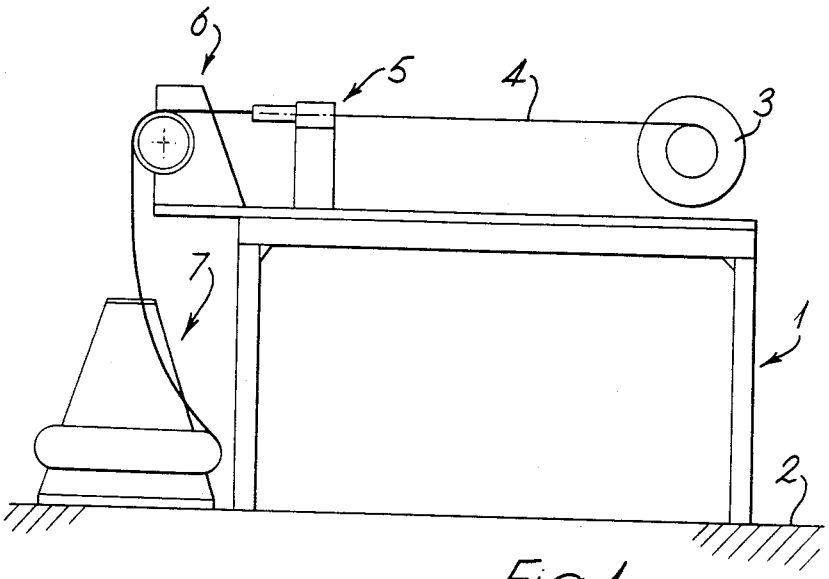
FIG. 1 is a schematic view of a drawing machine.

The apparatus of FIG. 1 comprises a framework 1 and a coil support 7 mounted on a foundation 2. The framework supports a bull block 3 by which wire 4 is drawn from a coil on support 7, over a guiding roller 6 and through unit 5.

Figure 2:
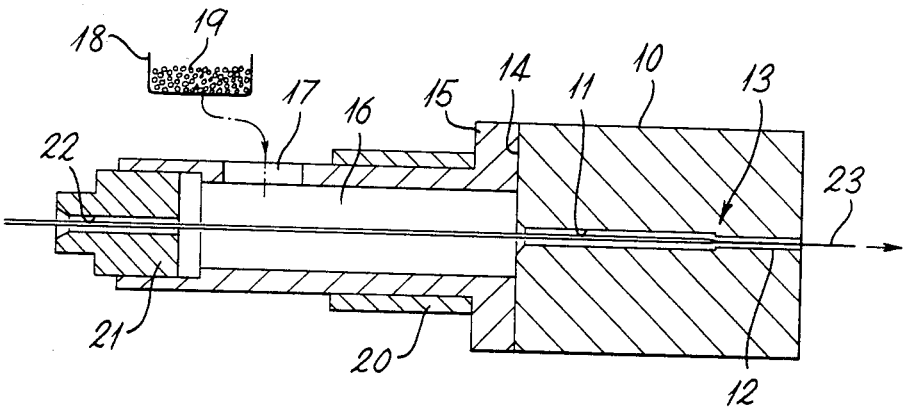
FIG. 2 is a diagrammatic section, in greater detail, through the reduction unit shown in FIG. 1.

As FIG. 2 shows, reduction unit 5 comprises a block 10 pierced by a circular-section bore in two parts: a first part 11 and a second part 12 of lesser radius, the two parts meeting at a step 13. The upstream face 14 of block 10 is sealed against the end flange 15 of a chamber 16 having an inlet port 17 which is adapted to be connected, in use, to a source 18 of a suitable lubricating and pressurising medium: for instance, low-density polyethylene granules 19. A jacket-type electrical heater 20 surrounds the wall of chamber 16, and the end of the chamber remote from flange 15 is closed by a plug 21 formed with a narrow bore 22 coaxial with bores 11 and 12.

To begin a drawing operation, the leading end 23 of the wire 4 is fed from the coil, over roller 6, through bore 21, through the interior of chamber 16, and through bores 11 and 12. It passes with clearance through all the bores because the section of the unreduced wire 4 is smaller than the section of any of them and in particular that of the bore 12 which will in practice be the smallest of the three. The interior of chamber 16 is then filled with polymer granules 19 from source 18 by way of inlet 17, heater 20 is energised to melt the polymer within the chamber and the leading end 23 of wire 4 is gripped and pulled by bull block 3. The wire while passing through chamber 16 drags the now-molten polyethylene 19 into the bores 11 and 12 where hydrodynamic action generates pressure and reduction in the wire diameter takes place. The amount of reduction in diameter depends upon many factors, among which the speed of drawing for a given geometry of the bores 11 and 12 and the rheology of the molten polymer at the operating temperature are significant, but the most significant parameter of all affecting the overall diameter of the finished wire is the minimum bore diameter within block 10: that is to say, in the example described, the diameter of bore 12.

Figure 3:
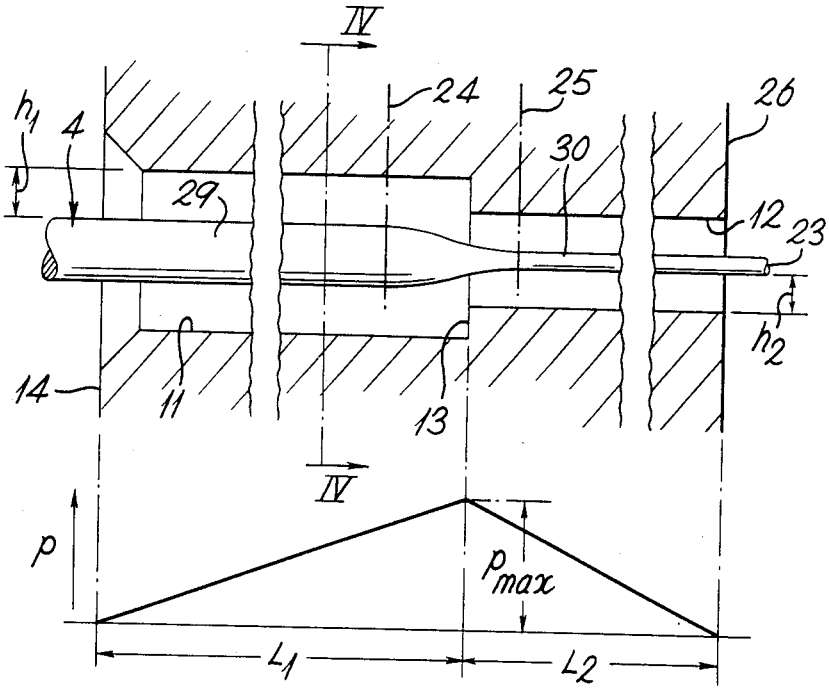
FIG. 3 is an enlarged view of part of FIG. 2.

FIG. 3 is an enlarged diagrammatic view of the bores 11 and 12 and the wire in the course of reduction within them during operation of the device. The locations of the radial planes 24 and 25 between which deformation actually takes place, and the profile of the deformation as it occurs between those planes, are determined by many factors well known to those in the art, but one of these factors is the pressure p of the molten polymer 19. Making certain reasonable assumptions, it may be shown that the maximum value $p_{max}$ that this pressure attains within the block 10 is:

$$p_{max} = \frac{6\xi V(h_1 - h_2)}{\frac{h_1^3}{L_1} + \frac{h_2^3}{L_2}}$$

where $\xi$ is the viscosity of the molten polymer, V is the drawing speed, $L_1$ is the axial distance between the step 13 and the face 14, $L_2$ is the axial distance between the step 13 and the downstream face 26 of block 10, $h_1$ is the radial clearance between the undeformed wire and the surface of bore 11 and $h_2$ is the radial clearance between the fully-deformed wire and the surface of bore 12. Other relevant factors remaining unaltered, the amount of reduction obtained will vary directly with the value of $p_{max}$, and tests have indicated that the value of $p_{max}$ obtainable in a die as shown in FIG. 3 is comparable with the value that could be obtained using a plain conical die (as described in the JMES article) of the same axial length, with an inlet diameter equal to that of bore 11 and an outlet diameter equal to that of bore 12. However tests indicate that the die of the present invention, as shown in FIG. 3, has the advantage illustrated by the graph at the foot of that Figure. The pressure within the melt 19 tends to rise in substantially linear fashion from the inlet to bore 11 (at face 14) to reach its maximum $p_{max}$ in the radial plane of the step 13, from which value it falls, again substantially linearly, to ambient where bore 11 ends at face 26. While the magnitude of $p_{max}$ is of course subject to variation in any one of a number of parameters, the axial coincidence of the maximum value with the step 13 appears to be consistent and in particular not to be subject to variation of the drawing speed V. This has the valuable consequence of making the locations of radial planes 24 and 25 and the general shape of the deformation that occurs between them more predictable, and thus of making the size and finish of the final drawn wire more predictable and consistent. In constrast, when a stepless conical die as described in the JMES article is used, it has been found that variations in the relevant parameters, and in drawing speed in particular, result in relatively unpredictable changes both in the profile of deformation and in the axial location at which $p_{max}$ occurs. These unpredictable changes lead to a product of relatively unreliable size.

Figure 4:
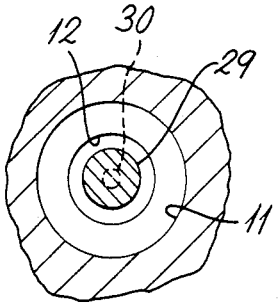
FIG. 4 is a section on the line IV—IV in FIG. 3.
Figure 5:
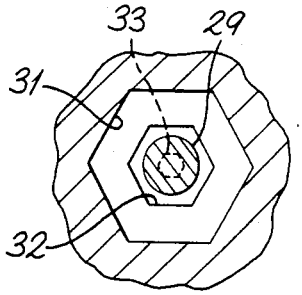
FIG. 5 is a section similar to that of FIG. 4, but of another apparatus.

FIG. 4 is a section through the die of FIG. 3 in which bores 11 and 12 are both circular: reference 29 indicates the surface of the wire 4 upstream of plane 24 and so before deformation begins, and reference 30 indicates the section of the fully-reduced wire downstream of plane 25. FIG. 5 is a section through an alternative apparatus according to the invention which may be used not only to reduce the section of round wire but also to change the shape of the section to polygonal—in this case hexagonal. In place of circular bores 11 and 12, bores 31 and 32 are now hexagonal in section, reference 29 again indicates the circular outline of the original wire upstream of radial plane 24, and reference 33 indicates the final, hexagonal outline of the fully-reduced wire downstream of plane 25.

Using the polyethylene melt 19 already described, reductions in section of the order of 20% have been achieved when drawing copper wire through apparatus according to the present invention. It should however be noted that liquids such as molten polymers are essentially non-Newtonian fluids, that is to say they exhibit a clearly non-linear relationship between stress and rate of strain. With suitable liquids of comparable vicosity and more Newtonian characteristics, it is anticipated that reductions of more like 40% in a single pass may be possible. It is also contemplated that the invention could be applied not only to drawing operations in which the work is pulled through the die, but also generally to extrusion (not only impact extrusion) operations on rigid components such as rod or bar (including hollow sections) in which the force required to pass the component through the die is applied at least partly by thrust rather than by pull. It is also contemplated that yet further improvements in wire reduction could be obtained by maintaining a temperature gradient along the length of the structure defining the stepped bore—that is to say the block 10 as shown in FIG. 2.

We claim:

1. A method of reducing an elongated component in section, comprising the steps of:

forcing said component in the presence of a homogeneous liquid in an axial direction through an axially-elongated die cavity a smallest orifice of which is of such size that said component before reduction will pass through it with clearance, for reducing said component by the action upon it of hydrodynamically-induced pressure within said liquid without contact between said component and said die cavity;

in the course of said reduction, causing said component within said axial length of said die cavity to pass a part of said die cavity of stepped form where there is a substantially instant diminution of the radial dimension of said die cavity, and imposing upon said component a gradual reduction in section beginning at a first radial plane axially upstream of said diminution of said radial dimension and ending at a second radial plane axially downstream of the same said radial dimension.

2. A method according to claim 1 in which said component is a rigid structure such as a rod, bar or tube, and in which at least part of said force applied to pass said component through said cavity is applied as a thrust upon said component from upstream of said cavity.

3. A method according to claim 1 in which said reduction in said section of said component is accompanied by a change in geometrical shape, for instance from round to polygonal.

4. A method according to claim 1 in which a temperature gradient is maintained along the length of said cavity.

5. Apparatus for reducing an elongated component in section and comprising:

a die presenting an axially-elongated cavity in which said reduction takes place, said cavity defining an axis of reduction and having an inlet and an outlet located at opposite ends of said cavity relative to said axis of reduction;

an axially-elongated reservoir having an axial length and communicating at a first end of its said axial length with said cavity inlet, said reservoir having a first aperture for the introduction of a lubricating and pressurising medium to said reservoir, and a second aperture located on said axis of reduction at a second and opposite end of the said axial length of said reservoir;

means for forcing said component through said reservoir and said cavity by way of said second aperture, cavity inlet and cavity outlet in succession, and for forcing said medium to pass from said reservoir through said cavity with said component, for reducing said component in section within said cavity by the action upon it of hydrodynamically-induced pressure within said medium but without contact with said die cavity, and means for imposing upon said component a gradual reduction in section thereof, said means comprising two axially-successive sections in said die cavity, at the meeting of which there is a substantially instant diminution in the radial dimension, relative to said axis of reduction, of said cavity for effecting said gradual reduction beginning at a first radial plane axially upstream of said dimunition of said radial dimension, and ending at a second radial plane axially downstream of said radial dimension.

6. Apparatus according to claim 5 in which heating means are associated with said reservoir, whereby said medium introduced into said reservoir in solid form by way of said first aperture may be melted into liquid form prior to passing into said cavity with said component.

7. Apparatus according to claim 5 in which said first aperture is arranged so that said medium entering said reservoir through said first aperture does so in a direction substantially at right angles to said axis of reduction.

8. Apparatus according to claim 5 in which both of said two axially-successive sections of said cavity are circular in section.

9. Apparatus according to claim 5 in which at least the latter of said two axially-successive sections of said cavity is of other-than-circular section.

10. Apparatus according to claim 9 wherein said other than circular section is polygonal.

* * * * *